US006679090B1

(12) United States Patent
Finch, Jr.

(10) Patent No.: US 6,679,090 B1
(45) Date of Patent: Jan. 20, 2004

(54) REMOVABLE CORE LOCK WITH INCREASED ROTATION

(75) Inventor: Glyn A. Finch, Jr., Simpsonville, SC (US)

(73) Assignee: CompX International, Inc., Mauldin, SC (US)

( * ) Notice: Subject to any disclaimer, the term of this patent is extended or adjusted under 35 U.S.C. 154(b) by 0 days.

(21) Appl. No.: 10/339,896

(22) Filed: Jan. 10, 2003

(51) Int. Cl.[7] ..... E05B 29/04
(52) U.S. Cl. ..... 70/369; 70/375; 70/421
(58) Field of Search ..... 70/372, 375, DIG. 62, 70/421, 367–371

(56) References Cited

U.S. PATENT DOCUMENTS

| | | | | | |
|---|---|---|---|---|---|
| 1,954,209 | A | * | 4/1934 | Jacobi | |
| 1,990,934 | A | * | 2/1935 | Falk | |
| 2,061,456 | A | | 11/1936 | Falk | |
| 2,460,709 | A | | 2/1949 | Navarro | 70/369 |
| 4,398,405 | A | | 8/1983 | Patriquin | 70/369 |
| 4,416,129 | A | | 11/1983 | Thimot | 70/369 |
| 4,545,224 | A | * | 10/1985 | Zane | 70/39 |
| 4,633,689 | A | * | 1/1987 | Wolniak et al. | 70/379 R |
| 4,712,400 | A | | 12/1987 | Steinbach | 70/369 |
| 5,235,832 | A | * | 8/1993 | Lux et al. | 70/368 |
| 5,606,882 | A | * | 3/1997 | Larsen et al. | 70/369 |

* cited by examiner

*Primary Examiner*—Lloyd A. Gall
(74) *Attorney, Agent, or Firm*—Banner & Witcoff, Ltd.

(57) ABSTRACT

There is disclosed an improved rotatable cylinder lock having a removable lock core. The lock core is removable from the lock housing for locking applications that require the lock to have up to 180° of lock core rotation. The invention is accomplished through the use of a specially designed lock housing, lock core, adapter, and shifter. The lock housing has a cylindrical opening defining a groove and rotational slot. Inserted within the cylindrical opening in the lock housing is an adapter having a stop lug and tumbler block, a shifter having a drive slot, and a lock core having a block restrictor relief. In use, the stop lug on the cylindrical adapter rotatably engages with the rotational slot in the housing while the tumbler block on the adapter rotatably engages with the block restrictor relief on the lock core. The assembly of the present invention thereby permits the lock core to be rotated 180° within the lock housing while also permitting the removal of the lock core.

7 Claims, 7 Drawing Sheets

REMOVABLE CORE LOCK WITH INCREASED ROTATION

FIELD OF THE INVENTION

The invention relates to rotatable cylindrical locks and more particularly to cylindrical locks having removable lock cores.

BACKGROUND OF THE INVENTION

It is known to use cylindrical locks with various applications. Cylindrical locks have been used with furniture, automobiles, doors, and the like. The known cylindrical locks have been designed and constructed for these various applications and these designs are somewhat dependent on the particular application and the environment in which the lock is used.

In many applications using cylindrical locks the cylindrical locking mechanism is contained within the equipment. Once contained, only the key slot of the cylindrical locking mechanism is exposed. Because the cylindrical locking mechanism is contained, it is often difficult to repair the lock core within the cylindrical locking mechanism. Typically, it is often necessary to dismantle the equipment in order to gain access to repair the lock core. Similarly, if the user of the equipment desires to re-key the lock, it is necessary to dismantle the equipment in order to gain access to the lock core. Consequently, in these applications it is desired that the lock core be removable from the lock housing so that the lock core may be replaced, repaired or re-keyed.

It is further known in the art for cylindrical locking mechanisms to have removable lock cores. Cylindrical locking mechanisms of this nature are typically manufactured to have a groove that permits the lock core to rotate yet retains the lock core within the lock housing. Once the lock core is rotated to the unlocked position using the lock key, the lock core is released using a release key to manipulate the release tumbler such that the release tumbler will slidably engage the groove in the locking mechanism, thereby permitting the removal of the lock core. The release key is typically used only to remove the lock core and is not used to operate the lock. Exemplar cylindrical locks with removable cores are shown in U.S. Pat. Nos. 2,061,456 and 2,460,709.

Still further exemplar cylindrical locks with removable cores are disclosed in U.S. Pat. Nos. 4,398,405 and patent 4,416,129. Both of these patents use a special release tumbler that interacts with a special groove machined in the lock housing to release the lock core. During normal operation of the lock assembly, the special release tumbler interacts with a slot or groove in the cylinder to retain the lock core. The lock housing has a containment surface or inner surface that keeps the special release tumbler from being retracted in any position but the unlocked position. In both cases, the length of the release tumbler is greater than the diameter of the lock core so that it always protrudes from the lock core. One end of the special release tumbler is shaped such that it will fit through the special groove machined in the lock housing when the lock assembly is in the unlocked position and the special release tumbler is retracted using a release key or control key.

It will be understood and appreciated by those skilled in the art that with known locking mechanisms the lock housings have a groove manufactured in the housing to permit removal of the lock core. It will also be understood that a special tumbler must be employed, a tumbler different than the lock tumbler. These special manufacturing steps and additional parts add complexity and expense to the production of a cylindrical lock having a removable lock core.

An effort at overcoming these known problems is shown in U.S. Pat. No. 4,712,400. In that patent, there is shown a cylindrical lock having a removable lock core where the requirement for making a special groove in the lock housing, and the further requirement for a special release tumbler is eliminated. To this end, the lock housing is constructed with a tumbler block associated with a tumbler ledge formed on the interior surfaces of the cylindrical housing. The tumbler ledge extends inwardly a certain distance while the tumbler block extends inwardly for a slightly greater distance than the tumbler ledge. The tumbler ledge and tumbler block coact with a release tumbler located in the lock core. In this manner, the release tumbler will ride along and against a shoulder formed by the tumbler ledge and will be prevented from being actuated into its release position by the tumbler block. The tumbler block will prevent this actuation until the lock is manipulated to a certain position such that the release tumbler may be actuated by a release key and positioned out of blocking engagement with the tumbler block. The lock core is also constructed to include a block restrictor relief portion that permits 90° of lock core rotation. The block restrictor relief portion coacts and accommodates the riding of the tumbler block therein during the normal rotational movement of the lock core. The block restrictor relief portion has a circumferential length greater than the circumferential length of the tumbler block, such that when the lock core is manipulated to the release position, the release tumbler may be actuated by the release key such that the release tumbler disengages with the tumbler block and extends into the block restrictor relief area of the lock core. Once in this position, the lock core may be removed from the lock housing.

Known problems exist with respect to the cylindrical locking mechanism shown in U.S. Pat. No. 4,712,400. As an example, the locking mechanism is limited to lock cores having only 90° of rotation. Many current applications that require cylindrical locks also require lock cores that permit 180° of rotation. As a result, there remains a need in the art to provide, among other things, a cylindrical locking mechanism having a removable lock core where the lock core may be rotated 180° and where a special groove and tumblers are not required.

BRIEF SUMMARY OF THE INVENTION

In an exemplary embodiment, the present invention is directed to a rotatable cylindrical lock assembly having a removable lock core with the lock core permitting 180° of rotation. The cylindrical lock assembly of the present invention does not require the use of a special groove or tumbler. The rotatable lock assembly includes a lock housing, a lock core, an adapter, and a shifter. The lock housing has a cylindrical opening that receives and registers the lock core, adapter and shifter. Located within the cylindrical opening is a rotational slot that receives and engages the adapter. The adapter of the present invention includes a stop lug and a tumbler block. The stop lug is positioned in rotatable engagement with the rotational slot in the lock housing while the tumbler block is positioned in rotatable engagement with a block restrictor relief formed in the lock core. Once assembled, as the lock core is rotated from the locked position to the unlocked position, the lock core rotates freely until the edge of the tumbler block contacts the opposite side of the block restrictor relief. The adapter then moves clockwise along with the lock core until the stop lug contacts the opposite side of the rotational slot in the lock housing as the lock reaches the unlocked position. The total rotational movement of the lock core is 180°. In the unlocked position, the lock core is removable through the use of a release key.

DETAILED DESCRIPTION OF THE INVENTION

Figure 1:
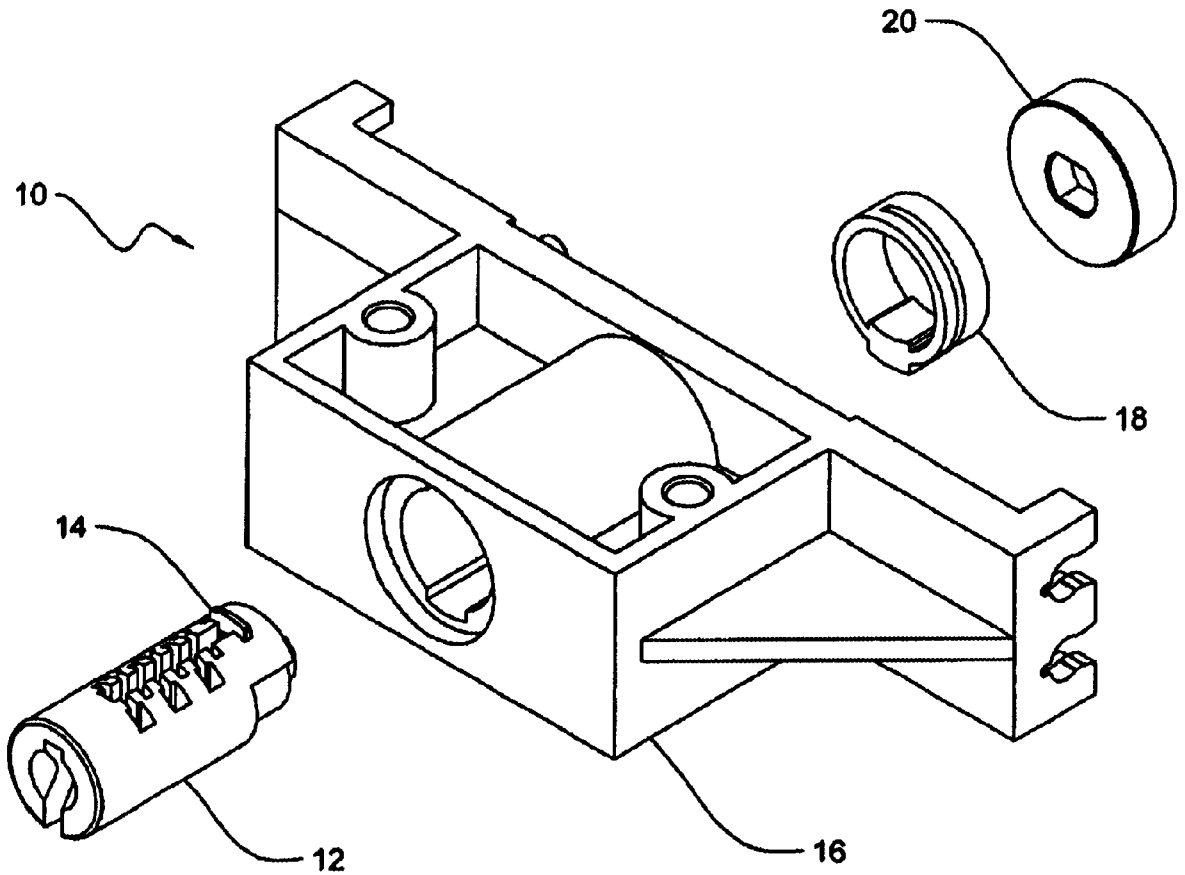
FIG. 1 shows an isometric view of a lock assembly of the present invention.

The invention may be embodied in various forms. Referring to the Figures wherein like numerals indicate like items, there is depicted in FIG. 1 an exploded isometric view of the lock assembly 10 of the present invention. In an exemplary embodiment, the lock assembly 10 includes lock core 12, release tumbler 14, lock housing 16, adapter 18, and shifter 20. Not shown in FIG. 1 but well known to those of skill in the art is a latch control assembly. The latch control assembly includes a latch that accomplishes the unlocking and locking function of the lock. The latch control assembly and the operation of the latch control assembly is well known and is not considered to form a part of the invention as it forms the part of any cylindrical lock assembly, including the present invention.

Figure 2:
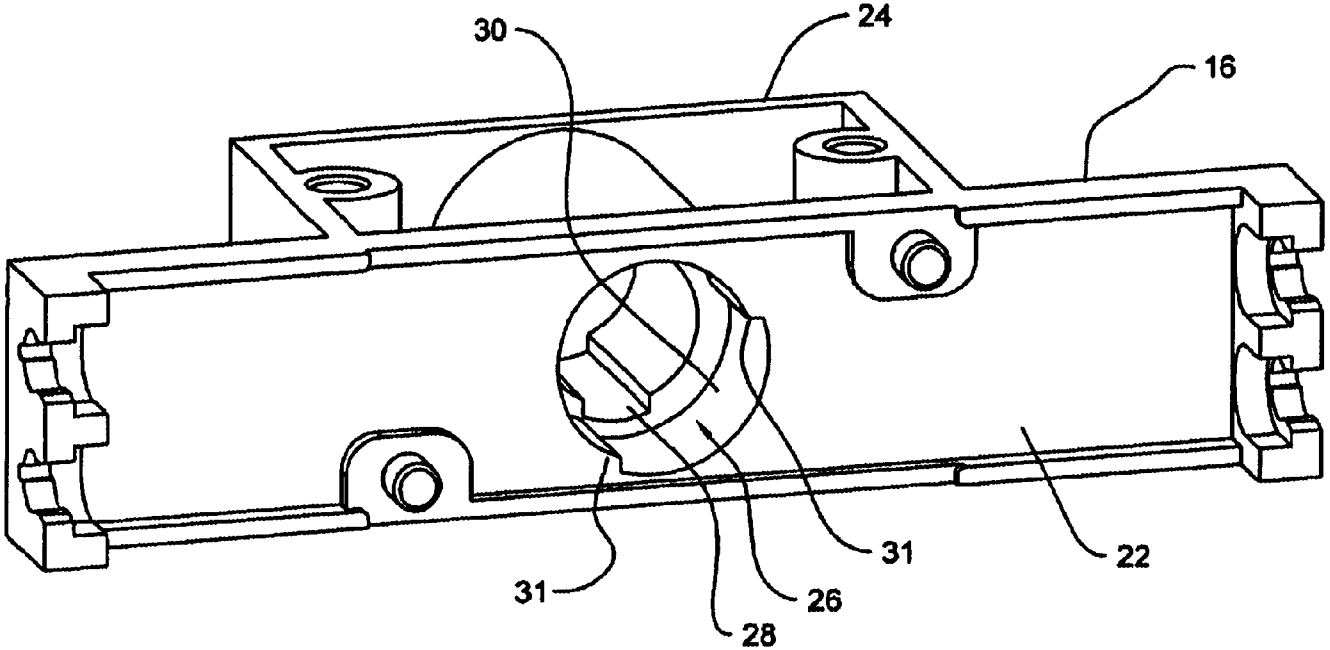
FIG. 2 shows an isometric view of the back of the lock housing of FIG. 1.

Referring to FIG. 2, the lock housing 16 includes an inner end 22 and an outer end 24. Depending on the application of the lock assembly 10, the lock housing 16 can take on many shapes and configurations, all of which are considered to be within the scope of the invention. A cylindrical opening 26 is located central to the exemplary lock housing 16 and extends between the inner end 22 and outer end 24 of the lock housing 16. As assembled, the cylindrical opening 26 receives and registers the lock core 12, adapter 18 and shifter 20, described in more detail below. The cylindrical opening 26 defines a groove 28 that extends longitudinally in the cylindrical opening 26 and aligns and registers the lock core 12. The cylindrical opening 26 also includes a rotational slot 30 that is recessed from the inner end 22 and aligns and registers the adapter 18. The rotational slot 30 extends around the periphery of the cylindrical opening 26 and is defined by a pair of ledges 31 that are formed on the interior surface of the cylindrical opening 26. The pair of ledges 31 extend inwardly a distance from the interior surface of the cylindrical opening 26. The adapter 18 aligns and registers within the rotational slot 30 between the ledges 3 1. The ledges 31 define shoulders against which the stop lug 32, described below, of the adapter 18 will contact to limit rotational movement of the adapter 18. The rotational slot 30 has a circumferential length that is greater than the circumferential length of the stop lug 32, thereby permitting rotational movement of the adapter 18 within the rotational slot 30 and therefore within the cylindrical opening 26. The shifter 20 registers with the cylindrical opening 26 and is positioned between the adapter 18 and the inner end 22 of the housing. The remaining structure of the housing 16 depicted in FIG. 2 is not material to the present invention and therefore will not be described in detail.

Figure 3:
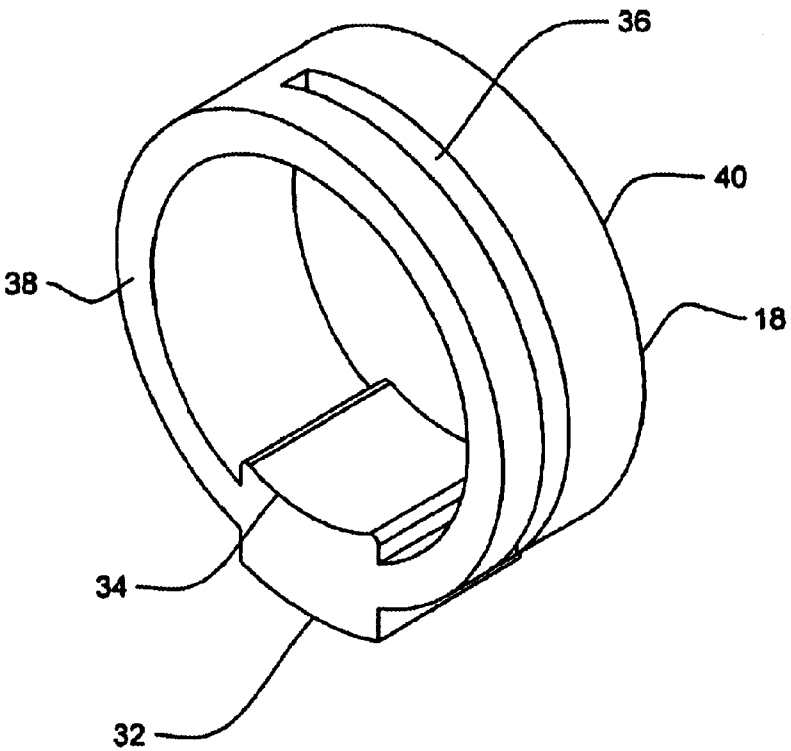
FIG. 3 shows an isometric view of the adapter of FIG. 1.

Referring to FIG. 3, the adapter 18 is depicted and includes a stop lug 32 that seats in the rotational slot 30 in the housing. The stop lug 32 in conjunction with the rotational slot 30 and ledges 31 serve to limit the rotation of the adapter 18 within the housing. That is, as the adapter 18 is rotated a certain distance within the rotational slot 30 in the lock housing 16, the stop lug 32 will abut against the ledge 31 and will be prevented from further rotation. The adapter 18 also includes a tumbler block 34 and retainer slot 36, described more fully below. The adapter further includes a front face 38 and a back face 40.

Figure 4:
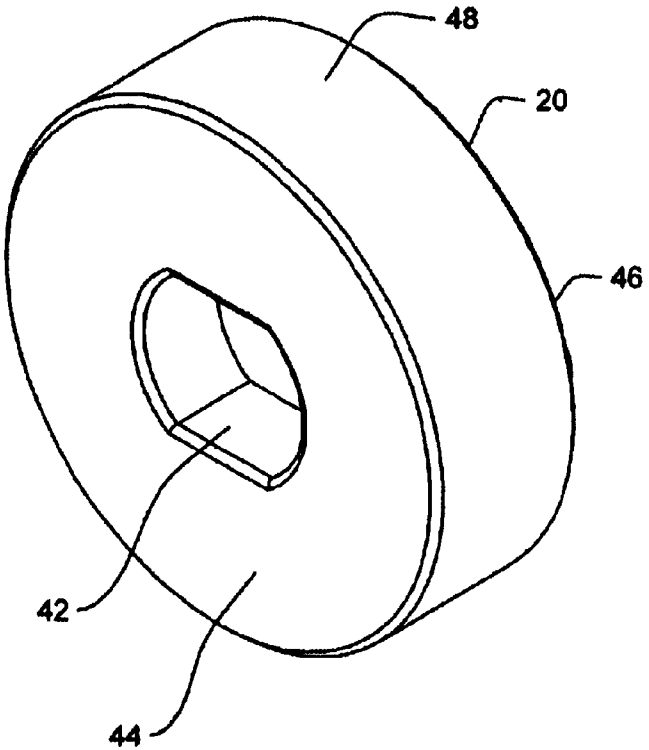
FIG. 4 shows an isometric view of the shifter of FIG. 1.

Referring to FIGS. 1 and 4, the shifter 20 is assembled to the housing 16 from the inner end 22. The shifter 20 includes a drive slot 42, a front face 44, and a back face 46. As assembled, the shifter 20 is positioned between the adapter 18 and inner end 22 of the lock housing 16 with the front face 44 of the shifter 20 locating off the back face 40 of the adapter 18. The shifter 20 has a cylindrical periphery surface 48 that registers in the cylindrical opening 26 and permits the shifter 20 to rotate freely within the cylindrical opening 26 in the lock housing 16. The adapter 18 and shifter 20 are retained in the lock housing 16 through techniques known to those skilled in the art and therefore will not be described in detail.

Figure 5:
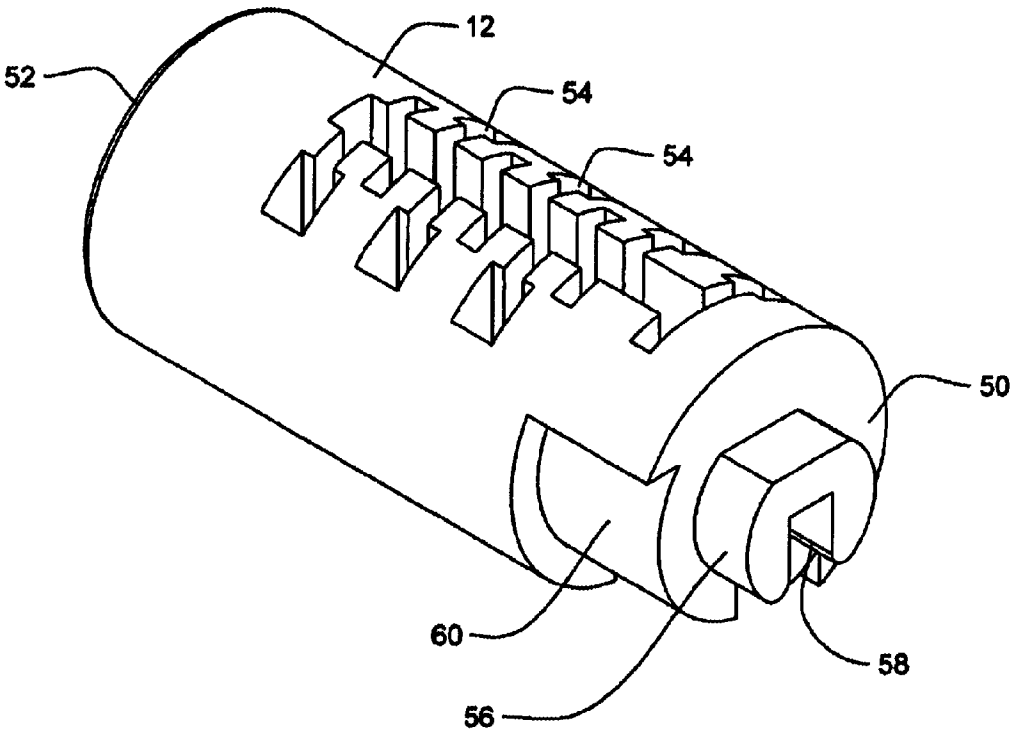
FIG. 5 shows an isometric view of the lock core of FIG. 1.

Referring to FIGS. 1 and 5, the lock core 12 is assembled to the housing 16 from the outer end 24. The lock core 12 has a cylindrical configuration with an inner end 50 and outer end 52 and is removably engagable with the lock housing 16. As assembled, the release tumbler 14 seats in the retainer slot 36 in the adapter 18 to locate the lock core 12 axially. The lock core 12 is provided with a plurality of tumbler slots 54 in which may be placed one or more lock tumblers, not shown, and the release tumbler 14. The lock tumblers and release tumbler 14 are arranged in horizontal alignment along the length of the lock core 12 as is well known in the art. The inner end 50 of the lock core 12 includes a latch control lug 56 that is received within and engages the drive lug 42 of the shifter 20. Once engaged, the shifter 20 will rotate with the lock core 12.

As is well known in the art, the lock core 12 is provided with a keyway passage 58, while the lock tumblers, not shown, and release tumbler 14 are provided with a similar keyway passage. The keyway passage 58 extends between the inner end 50 and outer end 52 of the lock core 12. The keyway passage 58 accommodates a bitted key that may be used to manipulate the lock tumblers according to a particular bitted configuration to release the lock tumblers from engagement with the groove 28 of the lock housing 16 allowing the lock assembly 10 to be rotated from the locked to the unlocked position.

The lock core 12 further includes a block restrictor relief 60 that cooperates with the tumbler block 34 of the adapter 18. The block restrictor relief 60 is formed along a portion of the circumferential length of the lock core 12. As depicted, the block restrictor relief 60 has a greater circumferential length than the circumferential length of the tumbler block 34 on the adapter 18. The tumbler block 34 is designed and adapted to ride within the block restrictor relief 60 in the lock core 12. The tumbler block 34 in conjunction with the block restrictor relief 60 acts to limit the rotation of the lock core 12 within the adapter 18. In other words, when the block restrictor relief 60 comes in contact with the tumbler block 34 the lock core 12 will be prevented from further rotational movement.

Figure 6:
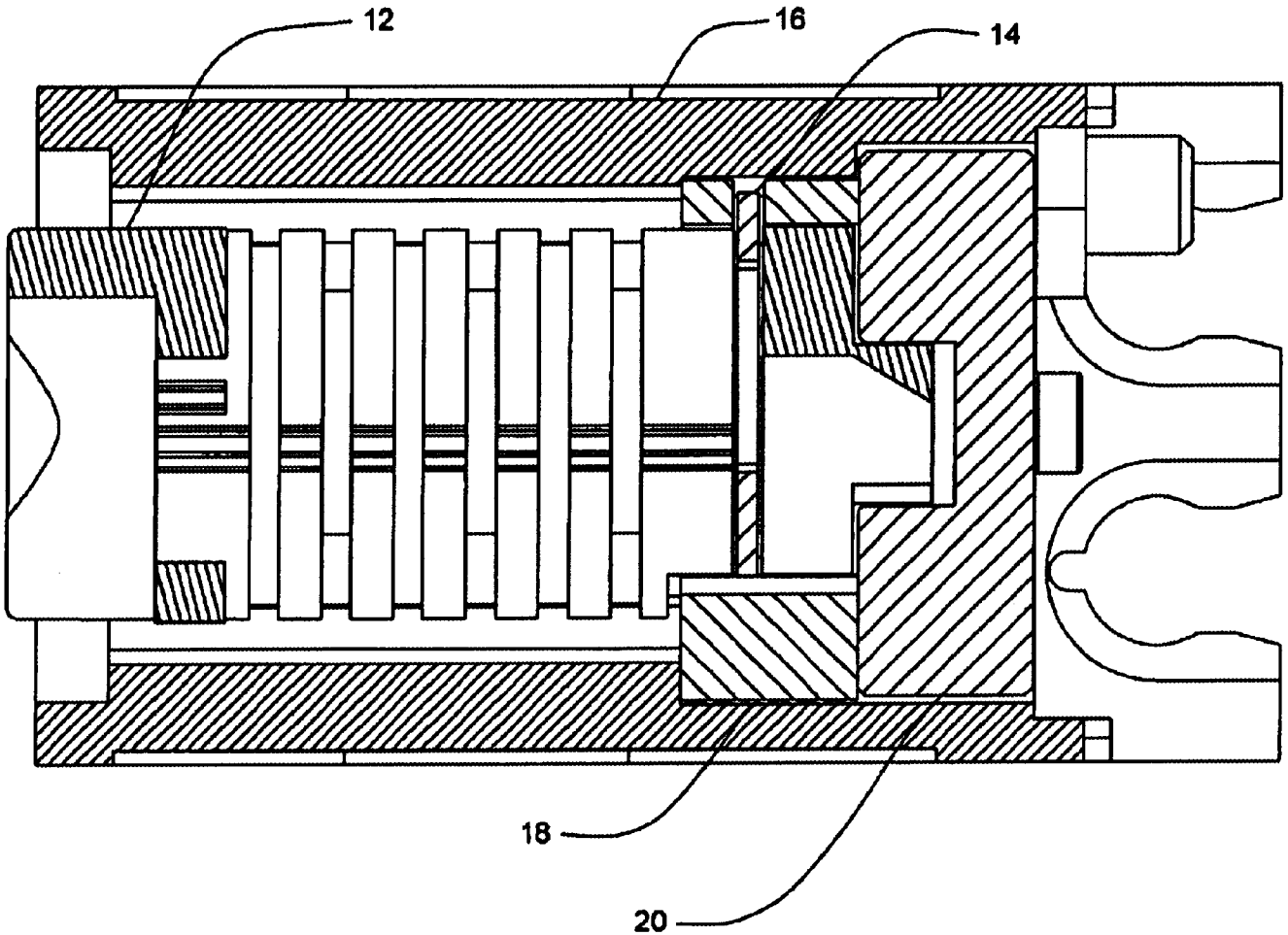
FIG. 6 shows a section view of the lock assembly of the present invention.
Figure 7:
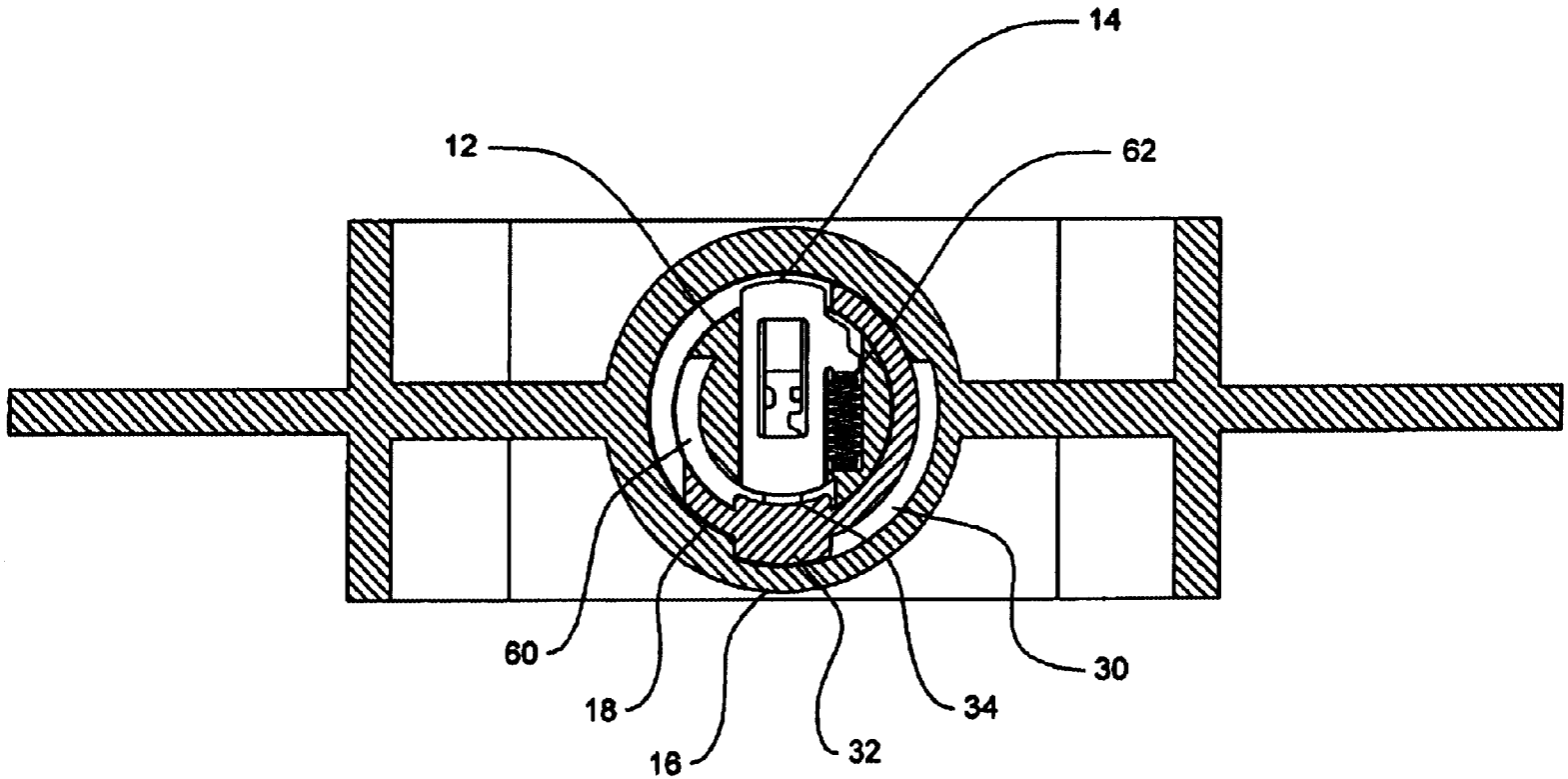
FIG. 7 shows a back section view of the lock assembly of FIG. 6 in a locked position.
Figure 8:
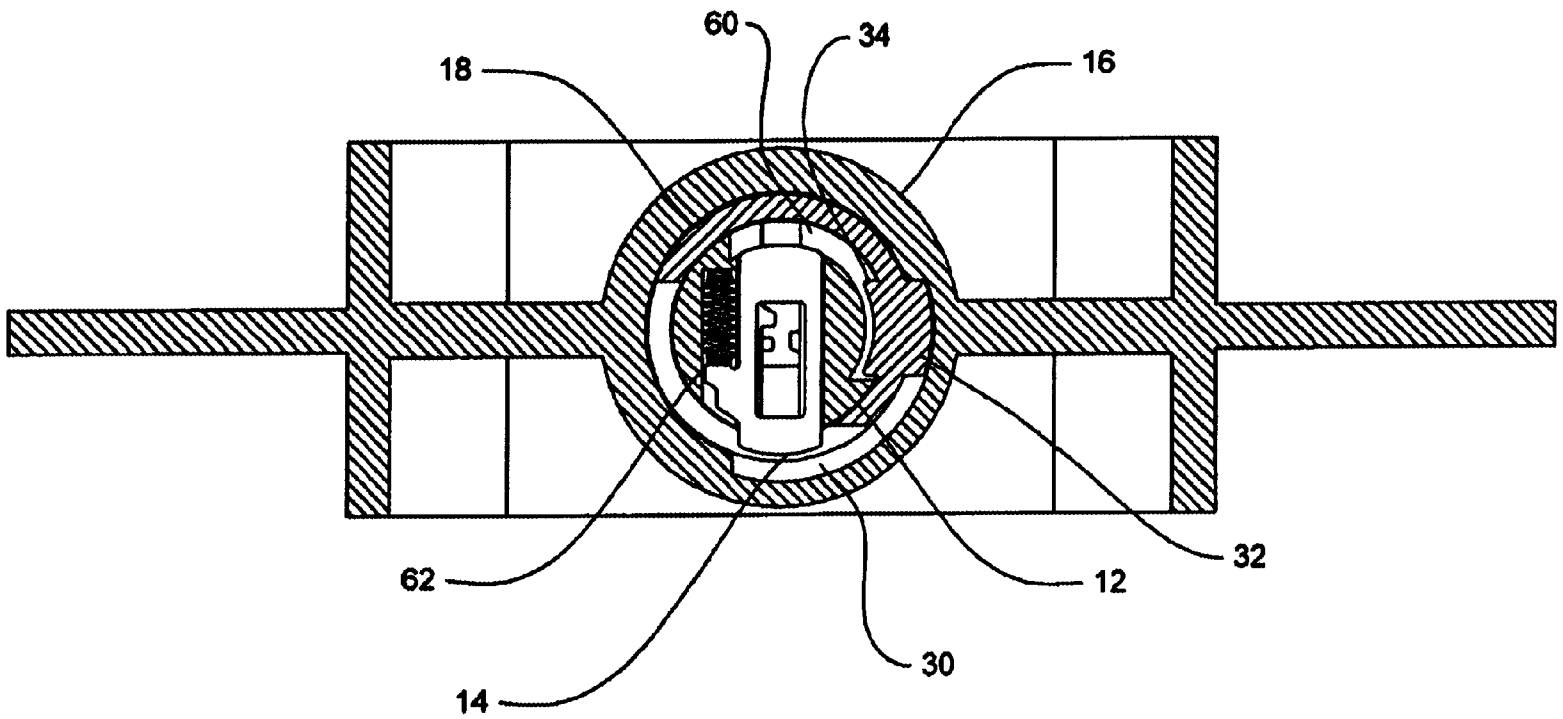
FIG. 8 shows a back section view of the lock assembly of FIG. 6 in an unlocked position.

Referring to FIGS. 6 and 7 there are shown section views of the lock assembly 10 of the present invention while in the locked position. In the locked position, the lock core 12 is fully rotated counterclockwise causing the tumbler block 34 to contact the side of the block restrictor relief 60 and also the stop lug 32 to contact the side of the rotational slot 30. The tumbler block 34 is located under the release tumbler 14, which prevents the lock core 12 from being removed. A release tumbler spring 62 is provided between the release tumbler 14 and the lock core 12. Referring to FIG. 8, which shows a back section view of the lock assembly 10 in the unlocked position, to achieve the 180° of lock core 12 rotation, as the lock core 12 is rotated clockwise to the unlocked position, the lock core 12 rotates freely until the edge of the tumbler block 34 contacts the opposite side of the block restrictor relief 60. The adapter 18 then moves clockwise along with the lock core 12 until the stop lug 32 contacts the opposite side of the rotational slot 30 in the lock housing 16 as the lock assembly 10 reaches the unlocked position. Once in this position, the tumbler block 34 is no longer located under the release tumbler 14 allowing the lock core 12 to be removed using the correct release key.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed is:

1. A rotatable cylindrical lock comprising:

a lock housing having a cylindrical opening further defining a groove and a rotational slot, the lock housing having an inner and outer end;

an adapter positioned in the cylindrical opening, the adapter having a tumbler block and a stop lug, the stop lug positioned within the rotational slot;

a shifter positioned in the cylindrical opening between the adapter and the inner end of the housing, the shifter having a drive slot;

a removable lock core positioned in the cylindrical opening, the lock core defining a plurality of tumbler slots, a block restrictor relief, and a latch control lug, the tumbler block positioned within the block restrictor relief, the latch control lug positioned in the drive slot; and a release tumbler positioned within one of the plurality of tumbler slots.

2. The rotatable cylindrical lock of claim 1 wherein the adapter has a tumbler slot.

3. The rotatable cylindrical lock of claim 1 wherein the removable lock core includes a keyway passage for receiving a bitted key.

4. The rotatable cylindrical lock of claim 1 further comprising a release tumbler spring positioned between the release tumbler and the lock core.

5. A rotatable cylindrical lock comprising:

a lock housing having a cylindrical opening further defining a groove and a rotational slot, the lock housing having an inner and outer end;

an adapter positioned in the cylindrical opening, the adapter having a tumbler block, a tumbler slot and a stop lug, the stop lug positioned within the rotational slot;

a shifter positioned in the cylindrical opening between the adapter and the inner end of the housing, the shifter having a drive slot;

a removable lock core positioned in the cylindrical opening, the lock core defining a plurality of tumbler slots, a block restrictor relief, and a latch control lug, the tumbler block positioned within the block restrictor relief, the latch control lug positioned in the drive slot; and a release tumbler positioned within one of the plurality of tumbler slots.

6. The rotatable cylindrical lock of claim 5 wherein the removable lock core includes a keyway passage for receiving a bitted key.

7. The rotatable cylindrical lock of claim 5 further comprising a release tumbler spring positioned between the release tumbler and the lock core.

* * * * *